United States Patent [19]

Wright

[11] 4,018,364

[45] Apr. 19, 1977

[54] FOAM DISPENSING DEVICE

[76] Inventor: Hershel Earl Wright, c/o Creative Products, Inc., 2670 E. Garfield Ave., P.O. Box 51, Decatur, Ill. 62525

[22] Filed: Feb. 9, 1976

[21] Appl. No.: 656,347

Related U.S. Application Data

[63] Continuation-in-part of Ser. Nos. 564,700, April 3, 1975, Pat. No. 3,937,364, and Ser. No. 564,701, April 3, 1975.

[52] U.S. Cl. ..... 222/190

[51] Int. Cl.[2] ..... B65D 83/14

[58] Field of Search ..... 222/190, 189, 402.18, 222/402.19; 239/343

[56] References Cited

UNITED STATES PATENTS 3,010,613 11/1961 Stossel ..... 222/190

*Primary Examiner*—Stanley H. Tollberg
*Assistant Examiner*—Hadd Lane
*Attorney, Agent, or Firm*—Cohn, Powell & Hind

[57] ABSTRACT

This foam dispensing device includes a flexible container for foamable liquid, having a discharge opening at one end. A foam producing assembly is housed within the container, the assembly including a self-supporting porous member of rigid material held within the neck of the container and a tubular member of non-porous material having one end extending into the porous member and the other end extending into the interior of the container. Fluid mixing within the porous member is facilitated by flow restriction, and an air return facilitates rapid container recovery.

12 Claims, 7 Drawing Figures

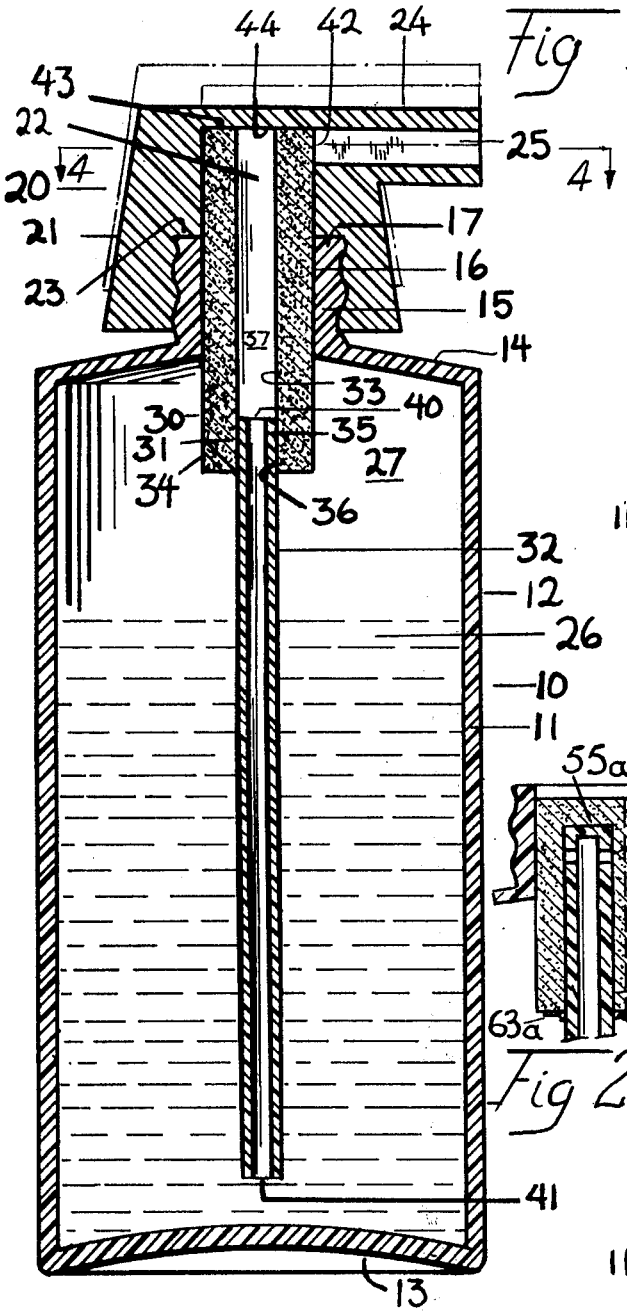
Fig 1
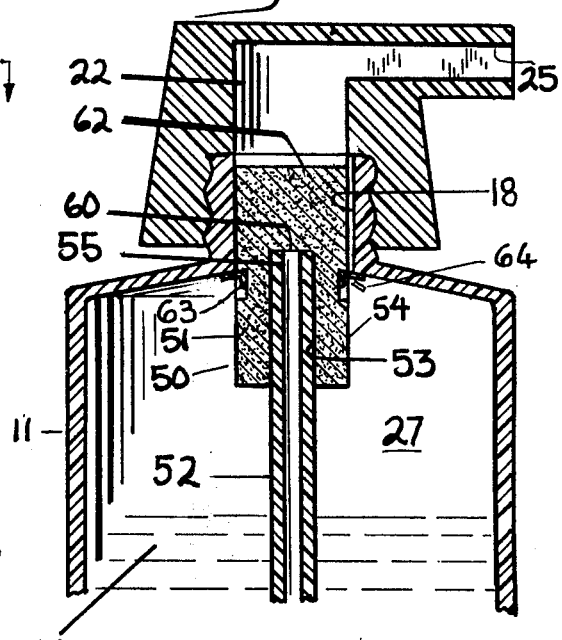
Fig 2.
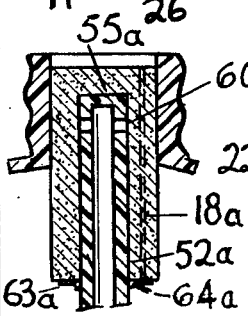
Fig 2A.
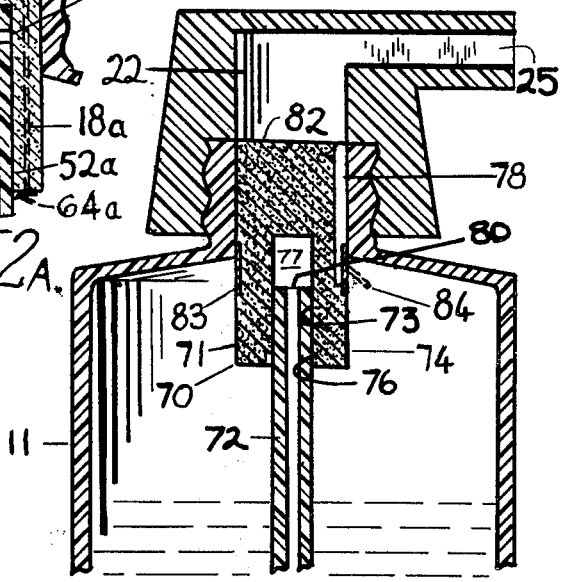
Fig. 3.
Fig. 4.
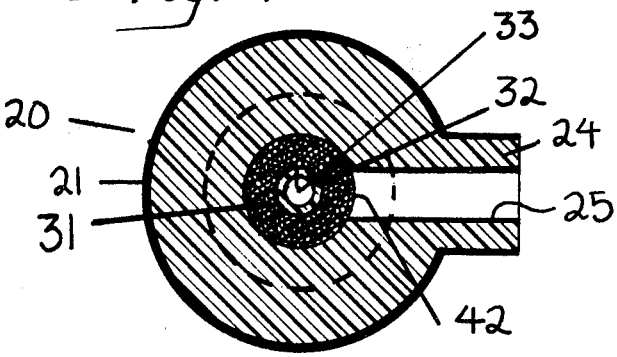

Fig. 5.
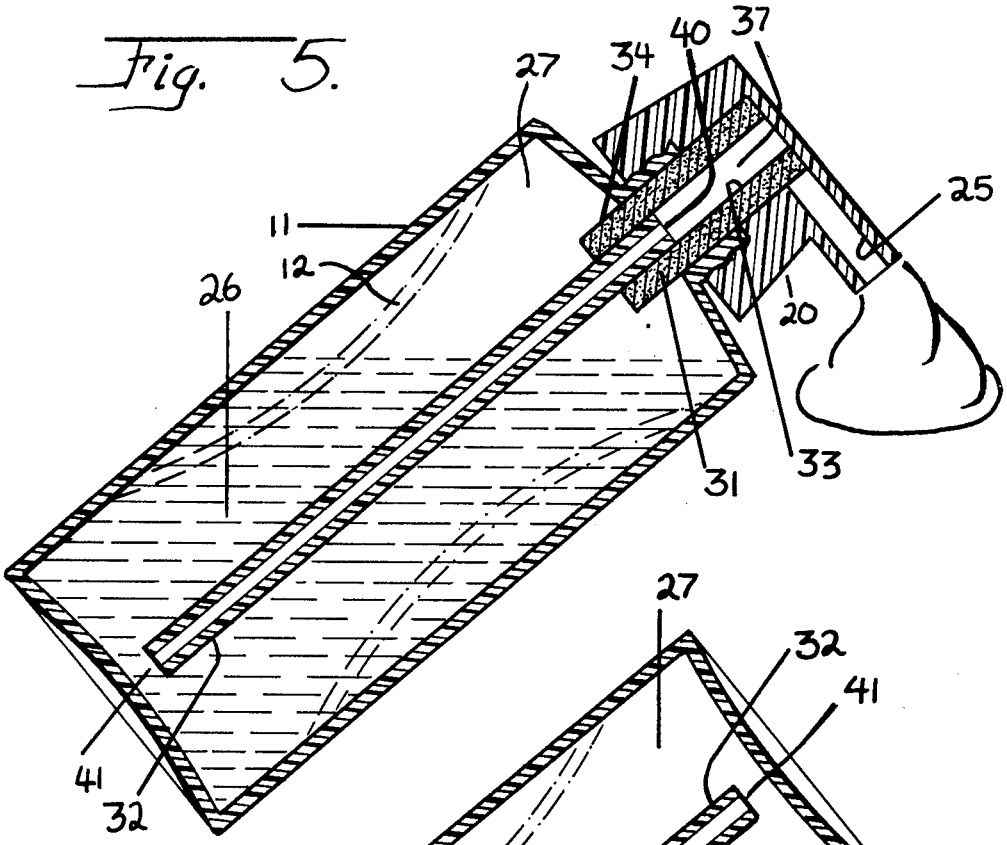
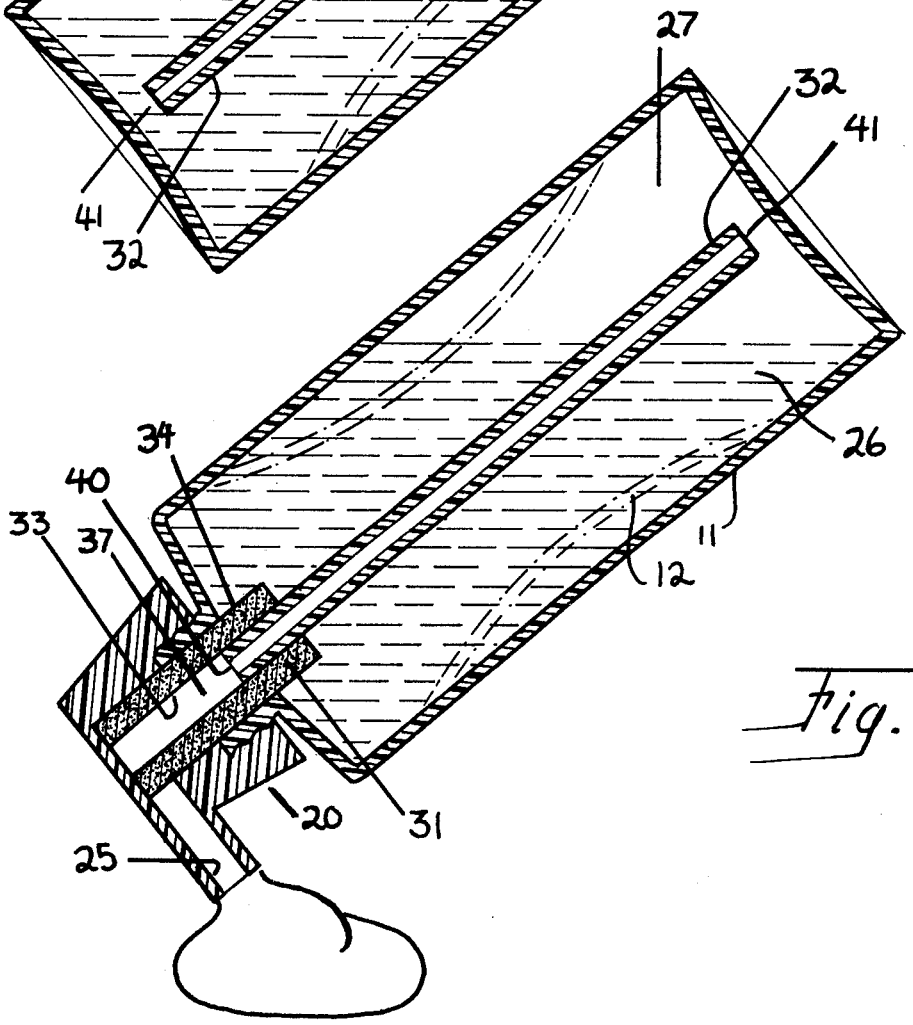
Fig. 6.

FOAM DISPENSING DEVICE

RELATED U.S. APPLICATION DATA

Continuation-in-Part of Ser. No. 564,701, Apr. 3, 1975 and Ser. No. 564,700, Apr. 3, 1975 now U.S. Pat. No. 3,937,364 of Feb. 10, 1976.

BACKGROUND OF THE INVENTION

This invention relates generally to manually compressible foam dispensers and particularly to dispensers having a rigid foam producing porous member.

The production of foam from flexible containers providing a deformable reservoir containing liquid and air which are intermixed prior to discharge is well known. Such foam dispensers provide an alternative to the well-known rigid type of container from which foam is dispensed under pressure by means of a compressed gas propellant. The rigid type of container is effective for its intended dispensing purpose but suffers from several serious objections. One of these is the high cost of the container which must be formed of a metal strong enough to withstand the internal gas pressure. Another objection results from the undersirability of expelling the fluorocarbon type of propellant commonly used into the atmosphere, as the release of such products creates potential ecological as well as health hazards, and further, this type of device is subject to explosion under some circumstances and therefore constitutes a safety hazard also. In addition to these objections, the pressurized type of device suffers from the disadvantage that the foam-forming gas used is not self-replenishing, thus limiting the useful life of the dispensing device.

The production of foam having optimum characteristics with respect to spreading, stability and wetting properties is dependent not only on the foamable liquid used but also on the means used to produce the foam. In general, the known non-pressurized, flexible container dispensers, utilize sponge-like porous elements of resilient material such as urethane foam, natural sponges and the like. Resilient material of this sort suffers from the inherent disadvantage that compression creates an undesirable change in porosity. A further disadvantage is that resilient materials of this sort are not self-supporting. Examples are disclosed in the patents issued to Stossel, U.S. Pat. No. 3,010,613; V. M. Bruno, U.S. Pat. No. 3,308,993; and A. L. Boehm et al., U.S. Pat. No. 3,422,993. Of these, the Boehm patent is believed to be the most pertinent. However, the porous member employed in this device is not self-supporting but requires a rigid inner holder mounted within the container to support the porous member. In addition, the area of the porous member exposed within the container is strictly limited and the exposure of the porous material to the fluid is indirect rather than direct. Further, the dip tube of the Boehm device does not extend into the porous member and there is a tendency for air and liquid to pass through the porous member without foaming.

It is also known that devices utilizing resilient porous material are incapable of passing granular materials such as finely ground pumice stone, polyethylene or silica, which is suspended in the liquid, without clogging the porous material.

The present device solves the above and other problems in a manner not disclosed in the known prior art.

SUMMARY OF THE INVENTION

This foam dispensing device produces foam from a foamable liquid and air without utilizing a rigid pressurized container and is completely free from ecological, health and safety hazards. It is operated by hand pressure and is structured to provide a self-replenishing air supply.

It is an important object of this invention to provide a foam dispenser having a container formed from flexible material and housing a foam producing means which includes a self-supporting porous member of rigid material and an attached, non-porous, elongate tubular member extending into the porous member at one end and into the interior of the container at the other end.

A further object is to provide a foam producing means in which, in response to compression of the container, liquid flows upwardly through the tubular member and into the interior of the porous member to wet the interior of said member, and air is forced into the porous member from the outer surface thereof to mix with the liquid and effectuate the formation of foam.

Yet another object is to provide a foam producing means in which, when the container is inverted and compressed, air flows downwardly into the interior of the porous member and liquid is forced into the outer surface of the porous member to mix with the air and effectuate the formation of foam.

Another object is to provide a porous member which is elongate and substantially cylindrical in configuration and which includes a longitudinal passage extending therewithin said passage receiving and supporting the tubular member therewithin and said passage having a flow restricting means at the outer end.

Yet another object is to provide a porous member having a structure in which a portion of the porous member is disposed outwardly of the tubular member to restrict axial flow through said passage, said portion providing a porous mixing chamber.

A further object is to provide a porous element having a peripherally continuous surface exposed to fluid within the container.

Another object is to provide a rapid air return between atmosphere and the interior of the container and to provide a one-way valve precluding outward air flow through the air return when the container is compressed.

It is another object to provide a porous member formed from substantially non-compressible spherical elements fused together to form a porous member having a constant void ratio and permitting the passage of finely suspended material through the member without clogging.

An important object of this invention is to provide a foam dispenser which is relatively simple in construction, easily and inexpensively manufactured and which can readily be used in an upright or inverted condition.

BRIEF DESCRIPTION OF THE DRAWINGS

FIG. 1 is a longitudinal sectional view through the container illustrating one type of porous member;

FIG. 2 is a fragmentary sectional view illustrating a porous member of modified construction;

FIG. 2A is a fragmentary sectional view illustrating an alternative tubular member;

FIG. 3 is a fragmentary sectional view illustrating another modified construction;

FIG. 4 is a cross sectional view taken on line 4—4 of FIG. 1;

FIG. 5 is a longitudinal cross sectional view illustrating the dispenser in use in one position; and FIG. 6 is a similar view illustrating the dispenser in use in an inverted position.

DESCRIPTION OF THE PREFERRED EMBODIMENT

Referring now by characters of reference to the drawings and first to FIGS. 1 and 5, it will be understood that the foam dispensing device is generally indicated by numeral 10 and includes a flexible container 11 of plastic or similar material having a sidewall portion 12, a lower end wall 13 and another end wall 14 which is formed to a threaded neck 15 providing an opening 16 which is defined by an annular end 17. A cap member 20 is provided which includes a body portion 21 compatibly threaded for attachment to the container neck 15 and having a longitudinal passage 22 extending upwardly from an annular abutment 23, the cap also including a spout 24 providing a transverse passage 25 communicating with the longitudinal passage 22 and defining a discharge port for the foam. When the cap is tightened the annular abutment 23 is sealingly engaged with the annular end 17 of the container neck 15. The foam is produced from foamable liquid 26 and air 27 within the container 11 by manually squeezing the container sidewall 12 as indicated in phantom outline in FIGS. 5 and 6, which show the container in the upright and inverted conditions respectively. The foam producing means housed in the dispenser will now be described with reference to the embodiment shown in FIG. 1.

The foam producing means is generally indicated by numeral 30 and includes upper and lower portions provided respectively by a hollow, cylindrical porous member 31 and a substantially non-porous tubular member 32. The porous member 31 includes a porous inner surface defining a passage 33 and a circumferentially continuous, longitudinally extending porous outer surface 34, which is of a diameter to be held within the container neck 15 and which is substantially exposed within the interior of the container 11. The tubular member upper end 35 has an outer diameter sufficiently large to be held within the lower portion 36 of the porous member passage as by adhesive means or friction, and the upper portion of said passage defines a cavity 37. The tubular member 32 includes an upper end opening 40 and provides a conduit means communicating with the conduit means provided by passage 33 and said tubular member depends downwardly into the interior of the container 11 to terminate in a lower end opening 41 disposed in close proximity to the container end wall 13.

It will be understood that, with the container 11 oriented as shown in FIG. 1, compression of the container sidewall results in an increase of air pressure within the container. This pressure acts downwardly on the upper surface of the foamable liquid 26 to effectuate flow of said liquid upwardly within the depending tubular member 32 and into the porous member 31 by way of end opening 40 to wet the porous surface of the cavity 37. At the same time, air within the container 11 is forced through the porous member outer surface 34 to intermix with the foamable liquid within the porous member 31 effectuate the formation of foam within said cavity. The foam so produced is passed through the porous wall portion indicated by numeral 42 and into the transverse discharge passage 25. The engagement of the porous member end 43 with the end of the cap passage indicated by numeral 44 directs the path of the foam through the wall portion 42 which provides a restriction means at the end of the passage 33 and restricts free flow of the foam to ambience, said wall portion effectuating further mixing. Release of the compression force on the container permits air to return to the container by way of passages 25, 33 and the rigid porous member 31. Continued or repeated compression of the container 11 will continue to produce foam and release of such pressure will continue to replenish the air supply.

When the container is inverted as shown in FIG. 6, the paths of the foamable liquid and air are reversed but the mixing effect is substantially the same. That is to say that when the container is pressurized, air 27 enters the tubular member 32 through the end opening 41 and is admitted through end opening 40 into the cavity 37 communicating with the interior of said porous member. At the same time, liquid 26 is forced through the outer surface 34 and into the interior of the porous member to effectuate mixing. The release of compression again results in the replenishment of air within the container. If the container is maintained in the inverted position when the pressure is released, air enters the container through the tubular member end opening 41. If the container 11 is returned to the upright position before release, air enters the upper portion of the container by way of passages 25, 33 and the porous member 31.

In those instances in which sufficiently dense foam is produced within the porous member the cap member 20 can be rotated upwardly to the position shown in phantom outline in FIG. 1 so that the cap passage end 44 is spaced from the porous member 31 thereby providing substantially uninterrupted communication between the passages 25 and 33, and facilitating the outward flow of foam and the replenishing of the air supply.

Referring now to FIG. 2 it will be understood that the dispensing device shown is similar to that described above in FIG. 1 with respect to the container 11, except for the provision of an alternate air return, channel 18 formed in the inner face of the neck 15. The device is distinguished by reason of the modified arrangement and configuration of the foam producing means. In FIG. 2 the foam producing means is indicated by numeral 50 and includes a porous member 51 and a non-porous tubular member 52. The porous member 51 includes a passage 53 and a porous outer surface 54. The tubular member 52 includes an upper end 55 which is received within the passage 53, an upper end opening 60 and a lower end opening (not shown). As shown in FIG. 2, the passage 53 does not extend through the porous member 51 but rather terminates to provide a substantial porous outer portion indicated by numeral 62. This porous portion 62 is disposed outwardly of the end opening 55 which provides a direct route for the foamable liquid 26 to enter into the interior of the porous member 51 when the container 11 is compressed. Air 27 enters the porous member 51 through the outer surface 54. The tubular member upper end 55 is received within the passage 53 and is attached to the porous member 51 as by adhesive or friction. The porous outer portion 62 immediately above the tubular member 52 restricts the flow of liquid and provides, in effect, a porous mixing chamber in which the foam is formed before being passed through the cap longitudinal passage 22 and transverse discharge passage 25 to ambience. It will be readily understood that when the container 11 is inverted, air is routed through the tubular member 52 by way of the lower end opening (not shown) and liquid is routed through the porous member outer face 54. As before, mixing occurs in the porous portion 62.

The air return channel indicated by numeral 18 is used in those instances in which a more rapid air return into the container is desirable than is achieved by air flow back into the container by way of the porous member. As shown in FIG. 2 the air return channel 18 is used in conjunction with a one-way valve element 63 of flexible elastomeric material, in the form of a washer recessed in the porous member and providing an annular flange 64. It will be understood that when the container 11 is compressed the flange 64 precludes the entry of air into the channel 18, but that upon the release of the pressure on the container 11 a portion of the flange 64 flexes, as indicated in broken outline, to permit air to return from atmosphere into the container through said channel 18.

FIG. 2A illustrates a device which is similar to that shown in FIG. 2 except that the tubular member 52*a* is provided with a closed end 55*a* and side openings 60*a*. In this embodiment the positive flow restriction provided by the closed end 55*a* directs the fluid transversely through the side openings to facilitate mixing of the fluids within the porous member before discharge to the cap passage (not shown). The air return channel 18*a* extends through the porous member and the washer 63*a* is disposed about the tubular member to provide a flexible flange 64*a*.

With reference to FIG. 3, the container shown is similar to that shown in FIG. 1. Distinguishing from FIGS. 1 and 2, the foam producing means indicated by numeral 70 and including porous member 71 and tubular member 72, provides a passage 73 having a lower portion 76 which receives the upper end 75 of the tubular member 72 in adhesive or frictional relation. The passage 73 thereby provides a porous surface cavity 77 above the end opening 80. The result of compressing the container 11 is that the liquid enters the interior of porous member 71 by way of the cavity 77. Air passes through the outer surface 74 of the porous member 71 and intermixes with the liquid within the porous member 71 to effectuate the formation of foam within said cavity 77. The foam is passed into the porous outer portion 82 which constitutes a restriction means and provides a porous mixing chamber. The foam passes by way of vertical passage 22 and transverse passage 25 to ambience. The tubular member 72 again includes a lower end opening (not shown) which is disposed in close proximity to the container end wall 13. As before, the container 11 can be used in the inverted condition.

As with the embodiment disclosed in FIG. 2, an air return channel, in this case indicated by numeral 78, is used in those instances in which a more rapid air return into the container is desirable. However, as shown in FIG. 3 the air return channel 78 is formed in the outer face of the porous member 71 rather than the neck of the container 11. In this structure the air return channel 78 is used in conjunction with a similar one-way valve element 83 in the form of a sleeve recessed into the porous member and having a flexible lower portion 84. It will be understood that when the container 11 is compressed said portion 84 precludes direct entry of air into the channel 78 but that upon release of the pressure on the container 11 the portion 84 flexes, as indicated in broken outline to permit air to return from atmosphere into the container through said channel 78.

It will, of course, be understood that the air return systems disclosed in FIGS. 2, 2A and 3 are interchangeable.

The non-compressible porous members in the preferred embodiment are formed from foraminous volcanic glass material; sintered glass, of the type used in filters; or non-compressible plastics such as porous polyethylene, polypropylene, nylon, rayon, and the like. Such materials can be manufactured to have a porosity which allows limited airflow therethrough and are, in the preferred embodiments, of the type that is composed of solid miniature spheres connected at their outermost surfaces so as to create voids therebetween as clearly shown in FIG. 4. This type of porous material permits the sphere size, and hence the pore size, to be controlled to produce a selected air resistance. The minature spheres are compressed together and locked at their contacting points with one another to form a porous structure maintaining an even porosity and substantially constant void ratio under pressure as distinguished from resilient, fibrous materials which are compressible and thereby provide reduced openings and variable porosity under pressure.

The foamable liquids used are preferably in the lower viscosity range of under 50 centipoises. Such liquids are capable of foaming with slight mechanical agitation and have a surface tension less than 50 dynes per centimeter. Because of the nature of the porous material as discussed above, the foamable liquid may contain non-dissolved granular materials such as pumice, silica, polyethylene, or polypropylene powders characteristically utilized in scouring cleaners. Solid particles such as vegetable fats, wax particles and the like may also be passed through porous materials of this type.

Foam quality is characterized by density, wetness, uniformity, cell size, rate of collapse and absorption against fine filter paper. Importantly, the density is affected primarily by the ratio of liquid to air employed in the production of the foam and the degree of interface contact resulting from the mechanical mixing technique utilized. It has been found that the quantity of air to be quantity of foamable liquid in the preferred embodiments described above varies between 10 to 100 cubic centimeters of air per gram of foamable liquid which, together with the mixing processes employed, produces a high quality foam.

I claim as my invention:

1. A foam dispensing device comprising:

a. a flexible container for holding a foamable liquid and air having a discharge port, b. a porous member, of rigid porous material, separating the area adjacent said discharge port and the interior of the container and having a passage extending at least partly through the porous member, c. conduit means including an opening communicating with the porous member by way of said passage, said conduit means extending into the interior of said container and including another opening communicating with the interior of said container.

2. A device as defined in claim 1, in which:

d. restriction means disposed outwardly of the passage restricts the free flow of fluid through said passage.

3. A device as defined in claim 2, in which:

e. said conduit means includes a non-porous elongate tubular member extending into said passage at one end and extending into the interior of the container for substantially the length of the container at the other end.

4. A device as defined in claim 1, in which:

d. the passage extends partially through said porous member, and the porous member material disposed outwardly of said passage provides a restriction means restricting the free flow of fluid through said passage.

5. A device as defined in claim 4, in which:

e. said conduit means includes a non-porous tubular member extending into said passage at one end.

6. A device as defined in claim 5, in which:

f. the passage includes a porous surface portion disposed outwardly of said non-porous tubular member.

7. A device as defined in claim 1, in which:

d. the container includes a reduced diameter neck portion, and e. the porous member is operatively carried by said neck portion and extends below said neck portion to provide a peripherally continuous, longitudinally extending area directly exposed to fluid within the container.

8. A device as defined in claim 7, in which:

f. the porous member is disposed in self-supporting relation within the neck of the container, and the conduit means includes a non-porous, elongate tubular member extending into the passage and being carried in supporting relation by said porous member.

9. A device as defined in claim 1, in which:

d. the porous member is formed from a plurality of substantially spherical elements fused together to define a predetermined void ratio.

10. A foam dispensing device comprising:

a. a flexible container for holding a foamable liquid and air having a discharge port, b. a porous member, of rigid porous material, separating the area adjacent said discharge port and the interior of the container, c. conduit means attached to the porous member including an opening communicating with the porous member, said conduit means extending into the interior of said container and including another opening communicating with the interior of said container.

11. A device as defined in claim 10, in which:

d. restriction means disposed outwardly of the conduit opening communicating with the porous member directs flow from the conduit means transversely into the porous member.

12. A device as defined in claim 10, in which:

d. a rapid air return is provided between atmosphere and the interior of the container, and e. one-way valve means substantially precludes direct fluid flow through the air return when the container is compressed.

* * * * *

UNITED STATES PATENT OFFICE

CERTIFICATE OF CORRECTION

Patent No. 4,018,364 Dated April 19, 1977

Inventor(s) Hershel Earl Wright

It is certified that error appears in the above-identified patent and that said Letters Patent are hereby corrected as shown below:

The term of this patent subsequent to February 2, 1993 has been disclaimed.

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

Patent No. 4,018,364 Dated April 19, 1977

Inventor(s) Hershel Earl Wright

It is certified that error appears in the above-identified patent and that said Letters Patent are hereby corrected as shown below:

Under Related U.S. Application Data

Cancel Ser. Nos. 564,700 and substitute Ser.No. 564,701 and Cancel Ser. No. 564,701 and substitute Ser.No. 564,700

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*

UNITED STATES PATENT OFFICE
CERTIFICATE OF CORRECTION

Patent No. 4,018,364 Dated April 19, 1977

Inventor(s) Hershel Earl Wright

It is certified that error appears in the above-identified patent and that said Letters Patent are hereby corrected as shown below:

The term of this patent subsequent to February 10, 1993 is disclaimed.

This certificate supersedes Certificate of Correction issued July 19, 1977.

Signed and Sealed this

Second Day of May 1978

[SEAL]

Attest:

RUTH C. MASON
Attesting Officer

LUTRELLE F. PARKER
Acting Commissioner of Patents and Trademarks